US009525223B2

(12) United States Patent
Little et al.

(10) Patent No.: US 9,525,223 B2
(45) **Date of Patent: *Dec. 20, 2016**

(54) FLIPPABLE ELECTRICAL CONNECTOR

(71) Applicant: HON HAI PRECISION INDUSTRY CO., LTD., New Taipei (TW)

(72) Inventors: Terrance F. Little, Fullerton, CA (US); Chih-Pi Cheng, New Taipei (TW); Chun-Yi Chang, New Taipei (TW); Stephen Sedio, Valley Center, CA (US); Ming-Lun Szu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,889

(22) Filed: Sep. 5, 2014

(65) Prior Publication Data

US 2015/0072562 A1 Mar. 12, 2015

Related U.S. Application Data

(63) Continuation-in-part of application No. 14/454,737, filed on Aug. 8, 2014, and a continuation-in-part of
(Continued)

(51) Int. Cl.
*H01R 24/00* (2011.01)
*H01R 12/70* (2011.01)
(Continued)

(52) U.S. Cl.
CPC ..... *H01R 12/7023* (2013.01); *H01R 4/66* (2013.01); *H01R 13/6275* (2013.01);
(Continued)

(58) Field of Classification Search
CPC ..... H01R 23/7023; H01R 23/7005
(Continued)

(56) References Cited

U.S. PATENT DOCUMENTS 5,073,130 A 12/1991 Nakamura
6,666,696 B1 12/2003 Wu
(Continued)

FOREIGN PATENT DOCUMENTS

CN 2604799 2/2004
CN 201230066 Y 4/2009
(Continued)

OTHER PUBLICATIONS

USB Type-C Specification 0.9c05-20140518.
(Continued)

*Primary Examiner* — Phuongchi T Nguyen
(74) *Attorney, Agent, or Firm* — Wei Te Chung; Ming Chieh Chang

(57) ABSTRACT

A plug connector includes a mating tongue defining top and bottom surfaces thereon. Each surface is provided with a plurality of conductors in one row wherein the characters/categories of the conductors on the top surface are sequentially arranged to be same with those on the bottom surface with a pair of power conductors in two notches at two lateral side edges. The corresponding receptacle connector mounted upon a printed circuit board, defines a receiving cavity to receive the mating tongue therein. Opposite top and bottom rows of contacts are respectively located by upper and bottom sides of the receiving cavity and categorized essentially in a same sequence with the conductors of the plug connector for respectively connecting to the corresponding conductive pads, respectively. A pair of power
(Continued)

contacts are located by two lateral sides of the receiving cavity to couple to the corresponding power conductor portions in the notches.

20 Claims, 27 Drawing Sheets

Related U.S. Application Data application No. 14/337,180, filed on Jul. 21, 2014, now Pat. No. 9,318,853.

(60) Provisional application No. 61/875,096, filed on Sep. 8, 2013, provisional application No. 61/916,147, filed on Dec. 14, 2013, provisional application No. 61/863,896, filed on Aug. 8, 2013, provisional application No. 61/866,037, filed on Aug. 14, 2013, provisional application No. 61/949,232, filed on Mar. 6, 2014, provisional application No. 61/867,574, filed on Aug. 19, 2013, provisional application No. 61/856,077, filed on Jul. 19, 2013, provisional application No. 61/857,687, filed on Jul. 23, 2013.

(51) Int. Cl.

| | |
|---|---|
| ***H01R 13/66*** | (2006.01) |
| ***H01R 4/66*** | (2006.01) |
| ***H01R 13/627*** | (2006.01) |
| ***H01R 24/60*** | (2011.01) |
| *H01R 13/642* | (2006.01) |
| *H01R 13/6582* | (2011.01) |
| *H01R 24/28* | (2011.01) |
| *H01R 107/00* | (2006.01) |
| *H01R 12/72* | (2011.01) |

(52) U.S. Cl.
CPC ..... *H01R 13/665* (2013.01); *H01R 13/6658* (2013.01); *H01R 24/60* (2013.01); *H01R 12/724* (2013.01); *H01R 13/642* (2013.01); *H01R 13/6582* (2013.01); *H01R 24/28* (2013.01); *H01R 2107/00* (2013.01)

(58) Field of Classification Search
USPC ..... 439/600, 626, 374, 377, 79, 733
See application file for complete search history.

(56) References Cited

U.S. PATENT DOCUMENTS

| | | | | |
|---|---|---|---|---|
| 6,755,689 | B2 | 6/2004 | Zhang et al. | |
| 6,890,220 | B2 | 5/2005 | Wang | |
| 6,916,198 | B2 * | 7/2005 | Wu | H01R 13/6589 439/497 |
| 7,114,981 | B1 | 10/2006 | Huang | |
| 7,445,469 | B2 | 11/2008 | Wu | |
| 7,534,150 | B2 * | 5/2009 | Shen | H01R 12/712 439/752 |
| 7,670,178 | B2 * | 3/2010 | Gu | H01R 13/65802 439/607.01 |
| 7,758,379 | B2 | 7/2010 | Chen | |
| 7,909,648 | B2 | 3/2011 | Tai | |
| 8,087,944 | B2 | 1/2012 | Kumamoto et al. | |
| 8,251,746 | B2 | 8/2012 | Zhang | |
| 8,262,411 | B2 | 9/2012 | Kondo | |
| 8,439,576 | B2 | 5/2013 | Hsiao et al. | |
| 8,517,773 | B2 | 8/2013 | Lee et al. | |
| 8,562,378 | B2 | 10/2013 | Su | |
| 8,968,031 | B2 | 3/2015 | Simmel et al. | |
| 8,968,033 | B2 * | 3/2015 | Little | H01R 13/6581 439/607.35 |
| 2010/0267261 | A1 | 10/2010 | Lin | |
| 2010/0311258 | A1 * | 12/2010 | Su | H01R 13/5213 439/136 |
| 2013/0095702 | A1 | 4/2013 | Golko et al. | |
| 2014/0024257 | A1 | 1/2014 | Castillo | |
| 2015/0056839 | A1 | 2/2015 | Zhang | |
| 2015/0162684 | A1 | 6/2015 | Amini et al. | |
| 2015/0171562 | A1 | 6/2015 | Gao et al. | |
| 2015/0214673 | A1 | 7/2015 | Gao et al. | |
| 2015/0214674 | A1 | 7/2015 | Simmel et al. | |
| 2015/0295362 | A1 | 10/2015 | Tziviskos et al. | |
| 2015/0340813 | A1 | 11/2015 | Ng et al. | |
| 2015/0340815 | A1 | 11/2015 | Gao et al. | |
| 2015/0340825 | A1 | 11/2015 | Ng et al. | |

FOREIGN PATENT DOCUMENTS

| | | |
|---|---|---|
| CN | 201282235 | 7/2009 |
| CN | 201392942 | 1/2010 |
| CN | 201523122 | 7/2010 |
| CN | 201623280 U | 11/2010 |
| CN | 201741935 | 2/2011 |
| CN | 201741937 U | 2/2011 |
| CN | 201868687 | 6/2011 |
| CN | 201887230 | 6/2011 |
| CN | 102544812 | 7/2012 |
| CN | 202423735 U | 9/2012 |
| CN | 202737282 U | 2/2013 |
| CN | 103081253 A | 5/2013 |
| CN | 203242848 | 10/2013 |
| CN | 103579835 | 2/2014 |
| CN | 203481540 | 3/2014 |
| JP | 2008300119 | 12/2008 |
| JP | 5873173 | 10/2014 |
| TW | M288035 | 2/2006 |
| TW | M357077 | 5/2009 |
| TW | M414692 | 10/2011 |
| TW | M443957 | 12/2012 |
| TW | M454654 | 6/2013 |
| TW | I427870 | 2/2014 |
| WO | WO2013020359 | 2/2013 |

OTHER PUBLICATIONS

Universal Serial Bus Type-C Cable and Connector Specification Revision 1.0 Aug. 11, 2014.
Universal Serial Bus Type-C Cable and Connector Specification Revision 0.7 Working Draft Jan. xx, 2014.

* cited by examiner

FLIPPABLE ELECTRICAL CONNECTOR

CROSS REFERENCE TO RELATED APPLICATIONS

This instant application is a CIP of the copending application Ser. No. 14/454,737 filed Aug. 8, 2014 which is a CIP of the application Ser. No. 14/337,180 filed Jul. 21, 2014, and further claims the benefit of, and priority to, U.S. Provisional Patent Application No. 61/875,096, filed Sep. 8, 2013, and No. 61/916,147, filed Dec. 14, 2013, the contents of which are incorporated entirely herein by reference.

BACKGROUND OF THE INVENTION

1. Field of the Invention

The present invention relates to an electrical connector, and more particularly to a flappable plug connector used with a receptacle connector.

2. Description of Related Art

U.S. Patent Publication No. 20130095702A1 discloses a dual orientation plug connector, which has a connector tab with first and second major opposing sides and a plurality of electrical contacts carried by the connector tab. The plurality of contacts may include a first set of external contacts formed at the first major side and a second set of external contacts formed at the second major side. The first plurality of contacts may be symmetrically spaced with the second plurality of contacts and the connector tab may be shaped to have 180 degree symmetry so that it can be inserted and operatively coupled to a corresponding receptacle connector in either of two insertion orientations.

A receptacle connector corresponds to the plug connector. A sensing circuit in the receptacle or the electronic device in which the receptacle connector is housed can detect the orientation of the contacts and switch internal connections to the contacts in the connector jack as appropriate. When the contacts are more, the sensing circuit is more complicated, which will waste software switches or hardware switches.

Hence, a new and simple electrical connector is desired.

SUMMARY OF THE INVENTION

Accordingly, the object of the present invention is to provide a flappable plug connector. The electrical connector assembly comprising: a housing unit essentially including a pair of housings each equipped with a plurality of contacts thereof, each of said contacts defining a front contacting section and a rear tail section; a paddle card sandwiched between the pair of housings with circuit pads mechanically and electrically connected to the corresponding rear tail sections, respectively; and a pair of metallic shells enclosing a rear portion of the housing unit but exposing a front portion of the housing unit to cooperate with a front region of the shell to be a mating tongue; wherein the front region of the shell mechanically and electrically connects to a corresponding grounding pad on the paddle card as an EMI (Electromagnetic Interference) touch pad.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention. Referring to FIGS. 1-15 showing a first embodiment including a plug connector 100 connecting with a cable 90 and a receptacle connector 200 mounted on a printed circuit board 91, the plug connector 100 is flappable in two direction and used with the receptacle connector 200.

Figure 1:
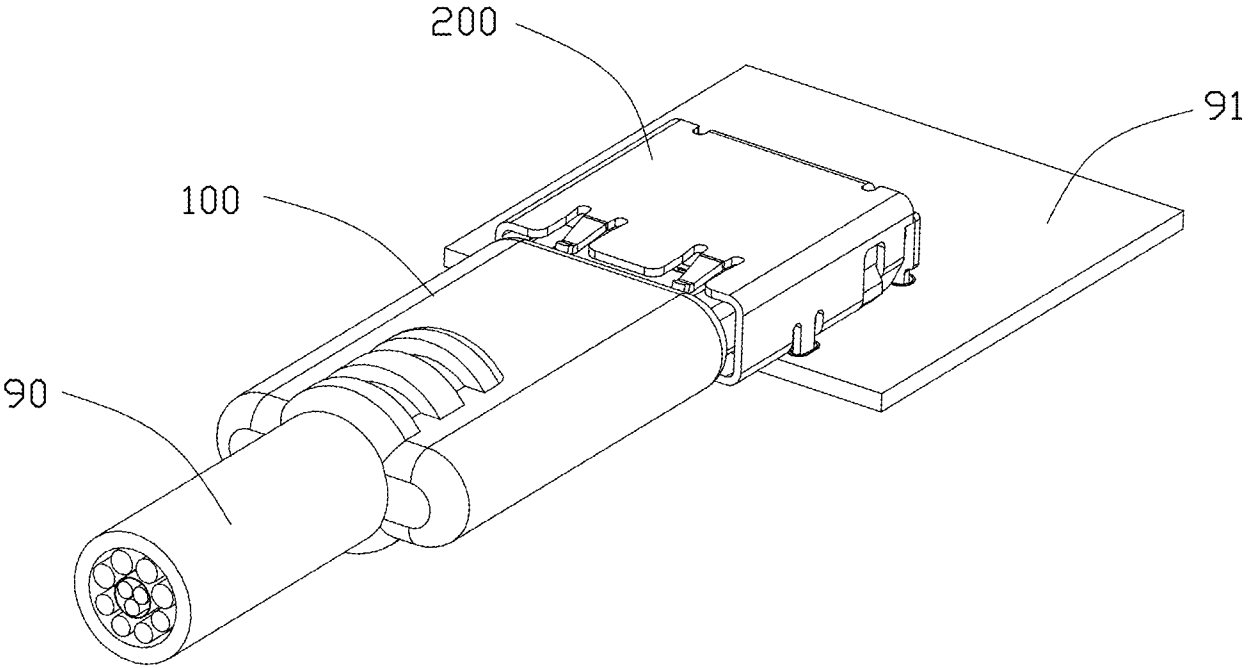
FIG. 1 is a perspective view of the plug connector and the receptacle connector mating with each other according to a presently first embodiment of the application.
Figure 2:
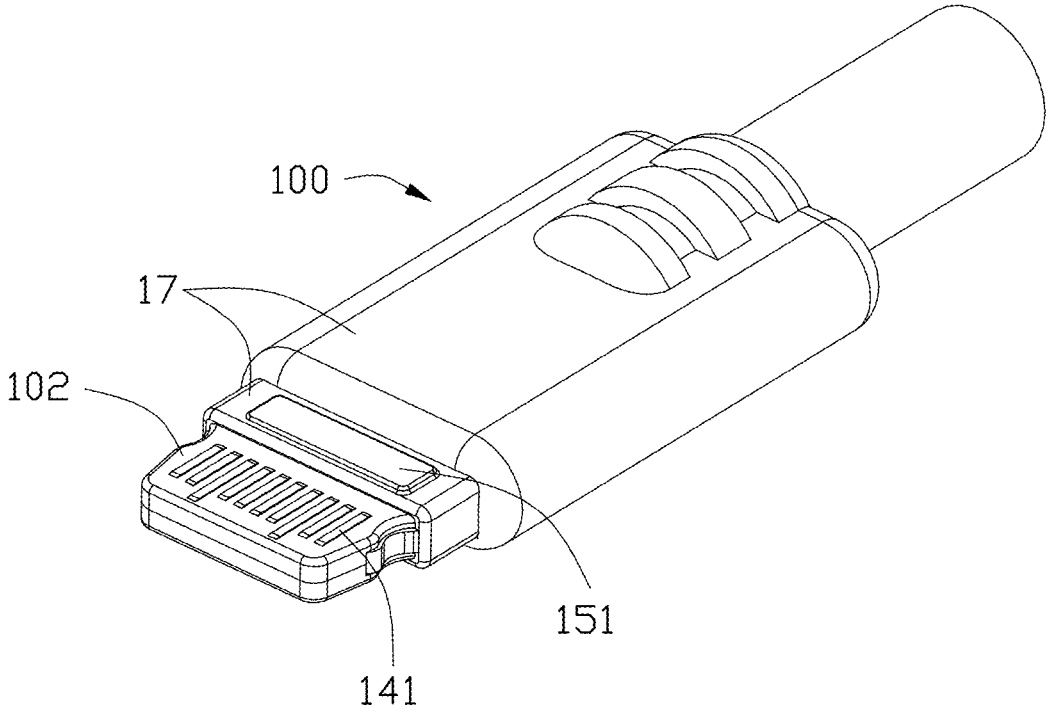
FIG. 2 is a perspective view of plug connector of FIG. 1.
Figure 3:
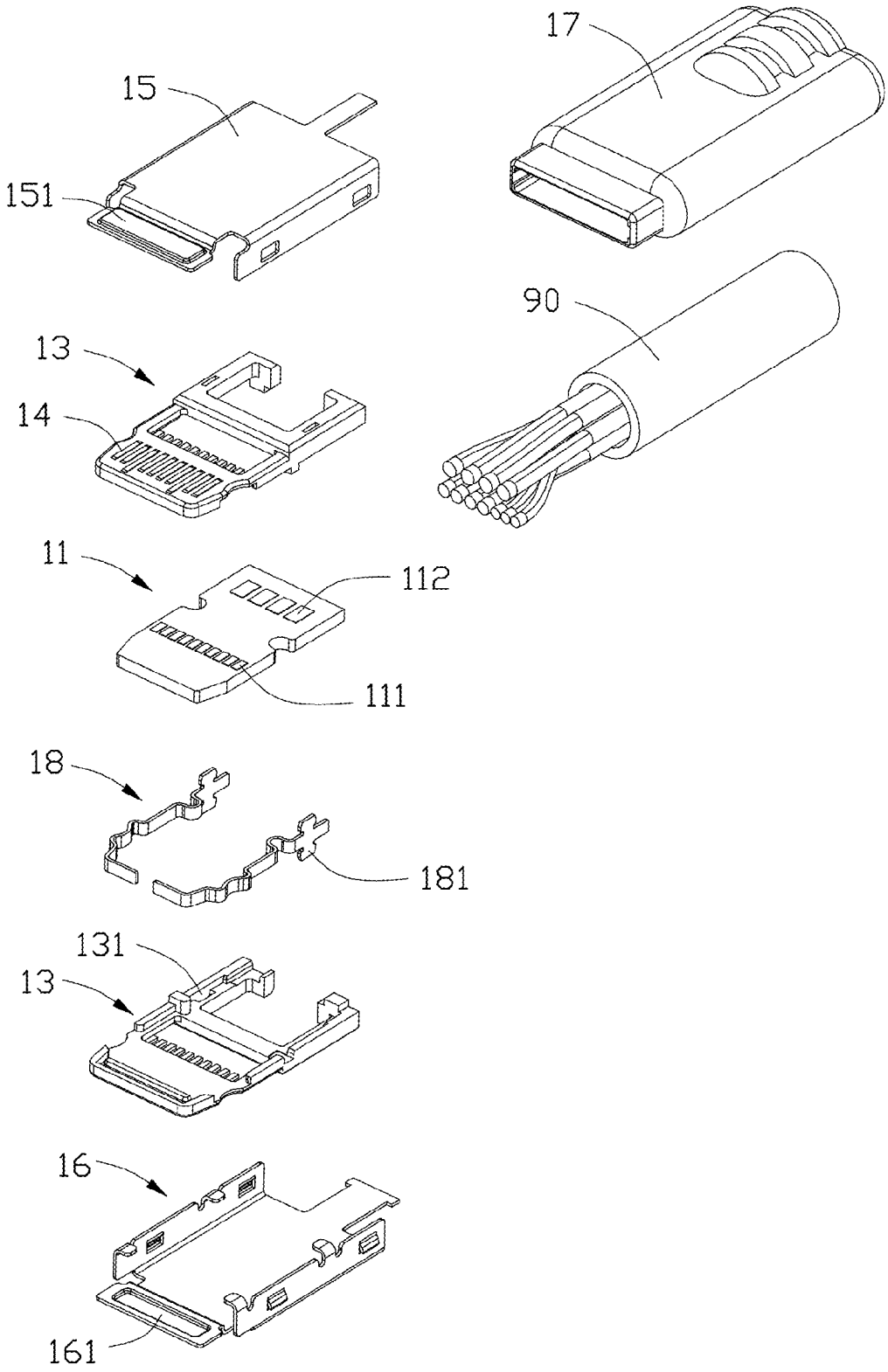
FIG. 3 is an exploded perspective view of the plug connector of FIG. 2.

Referring to FIGS. 2-3, the plug connector 100 include a mating tongue 102 of which two surfaces is embedded with blade contacts 141 and an EMI touch pad 151 projecting from an overmolded cover 17.

Referring to FIG. 3, the plug connector includes a paddle card 11 with circuit pads 111, 112 on two opposite surfaces, and a housing unit including a pair of identical housings 13 commonly sandwiching the paddle card 12 therebetween.

Figure 7:
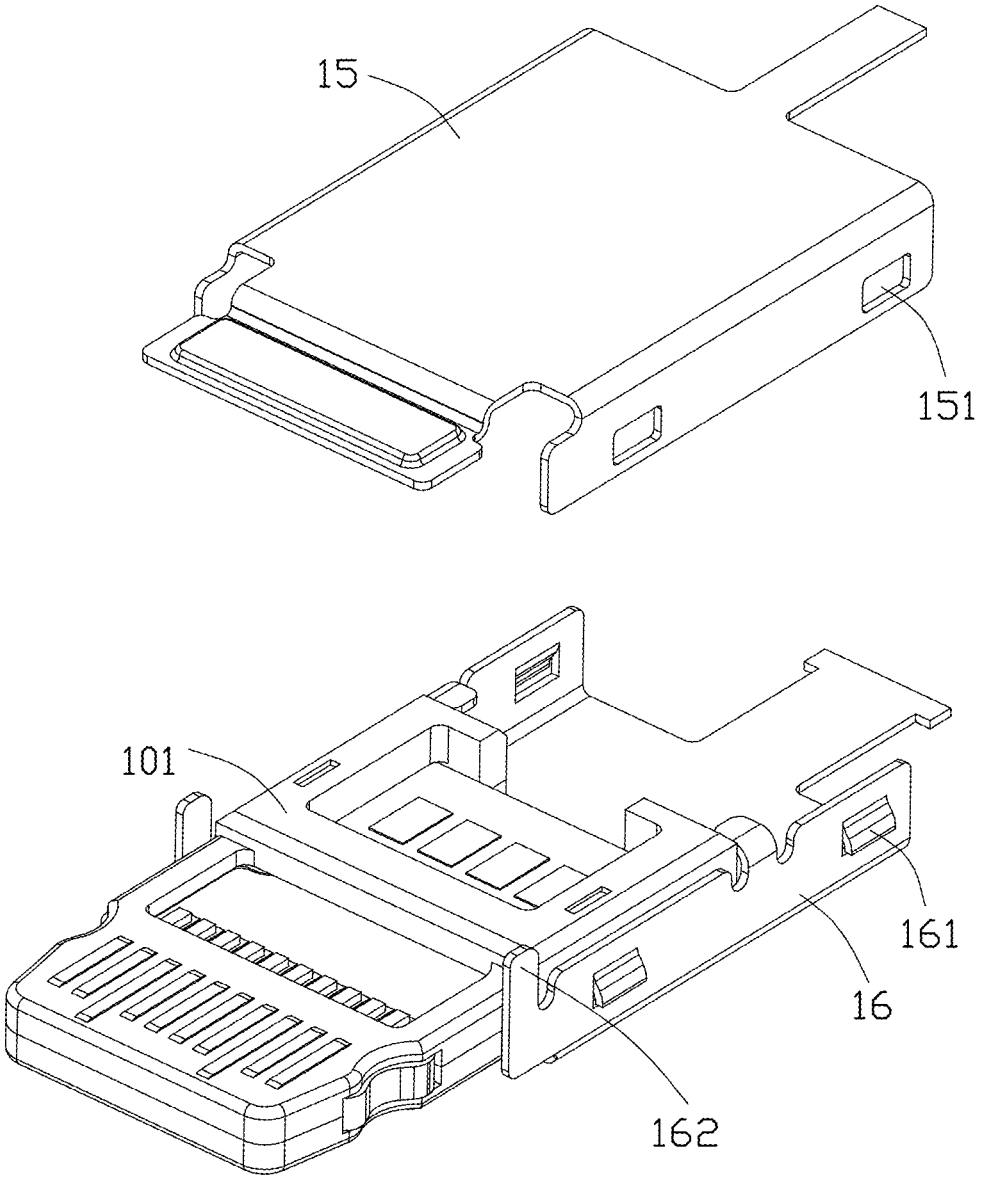
Figure 8:
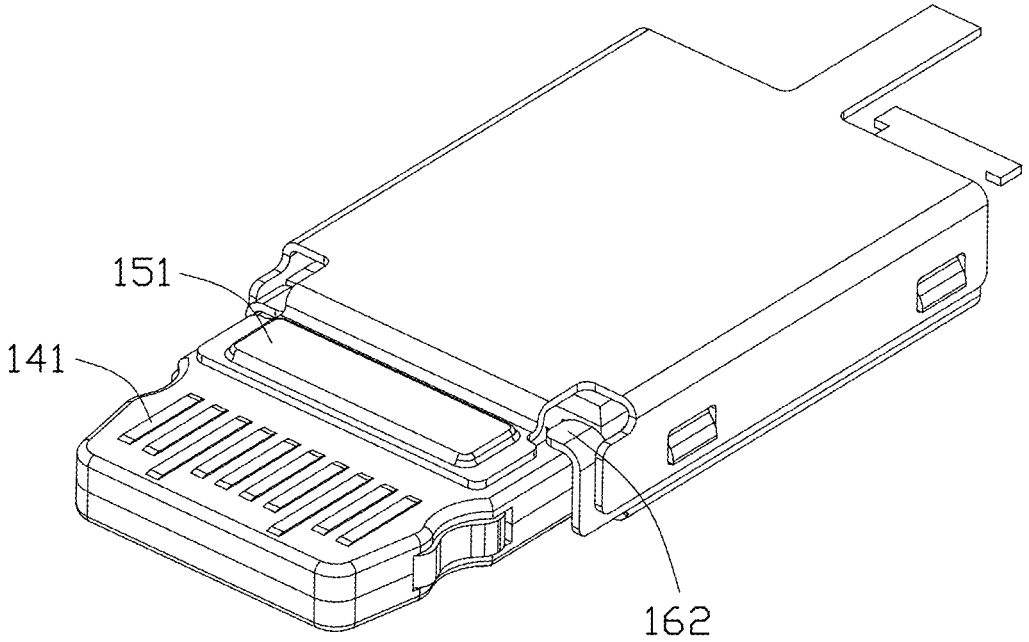
Figure 9:
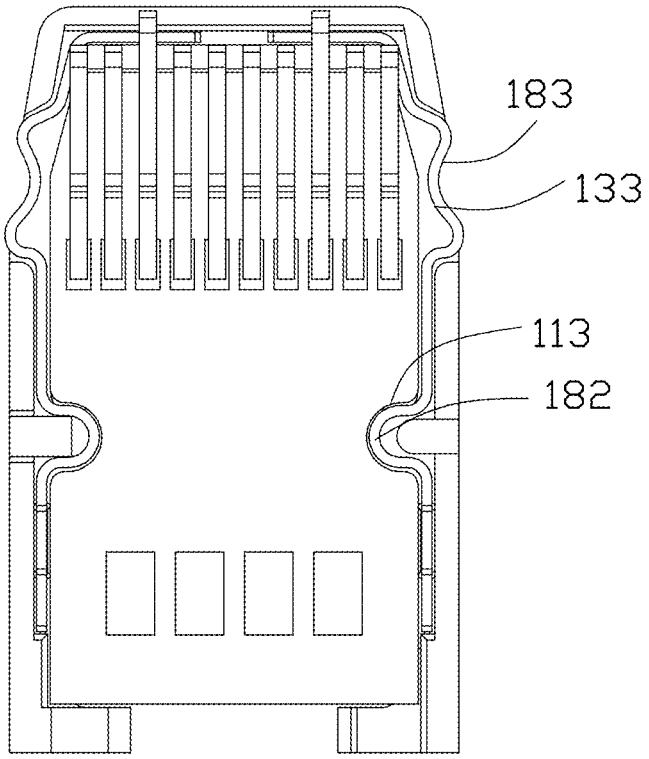
FIG. 9 is a top elevational view of the assembled paddle card and the bottom housing of FIG. 5.
Figure 10:
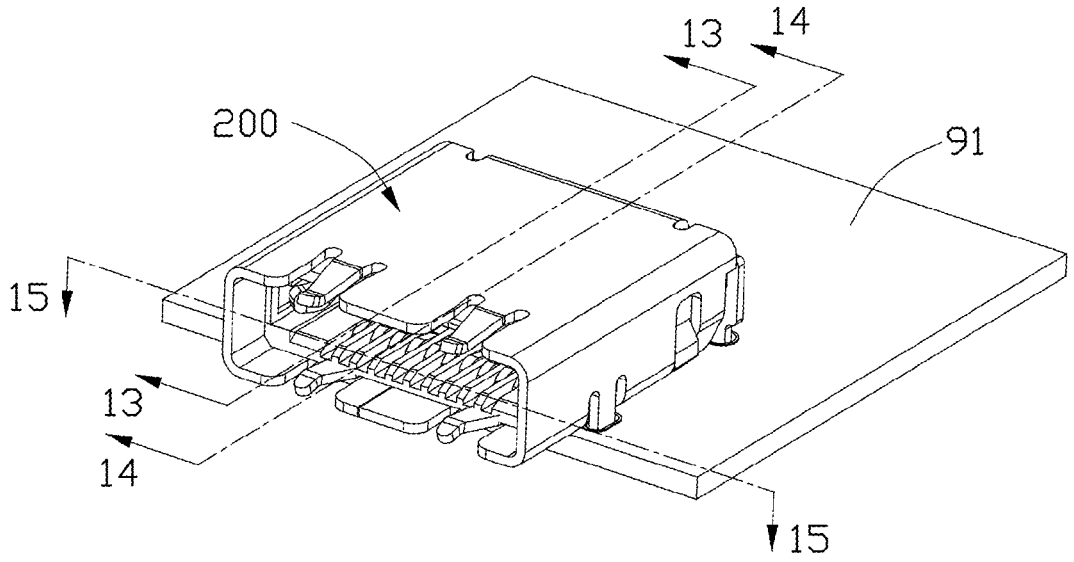
FIG. 10 is a perspective view of the receptacle connector of FIG. 1 and a printed circuit board on which the receptacle connector is mounted.
Figure 11:
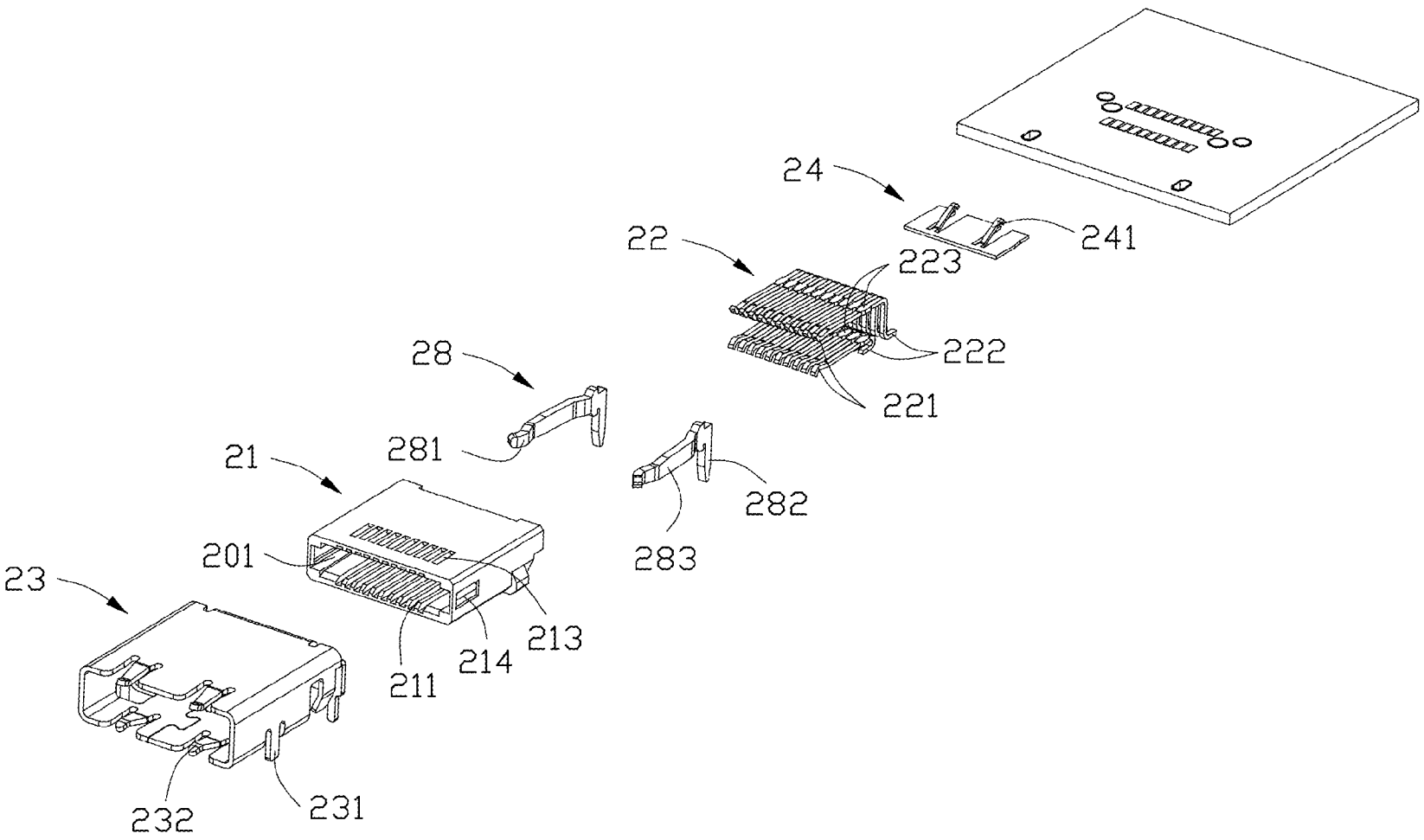
FIG. 11 is an exploded perspective view of the receptacle connector and the associated printed circuit board of FIG. 10.
Figure 12A:
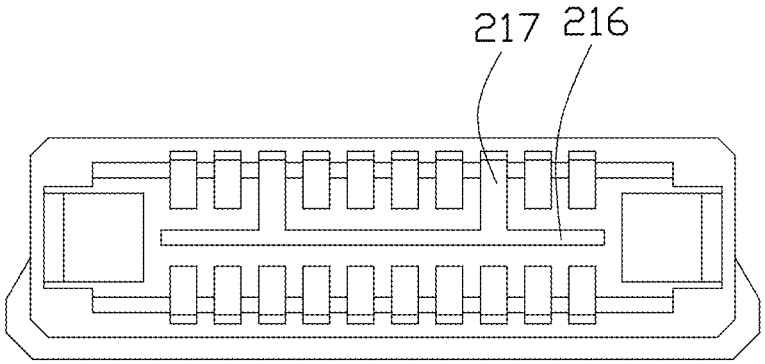
FIG. 12A) is a front view of the housing of the receptacle connector of FIG. 7.
Figure 12B:
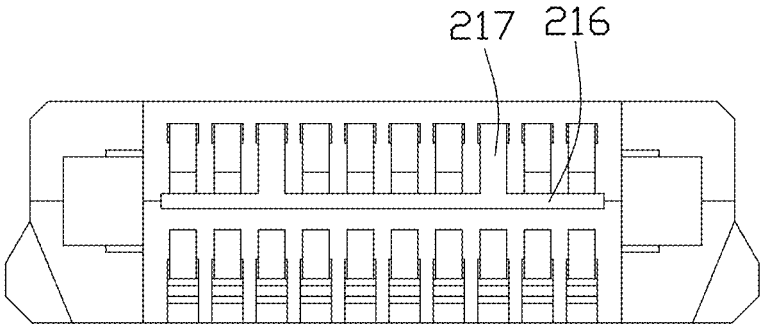
FIG. 12(B) is a rear view of the housing of the receptacle connector of FIG. 7.
Figure 13:
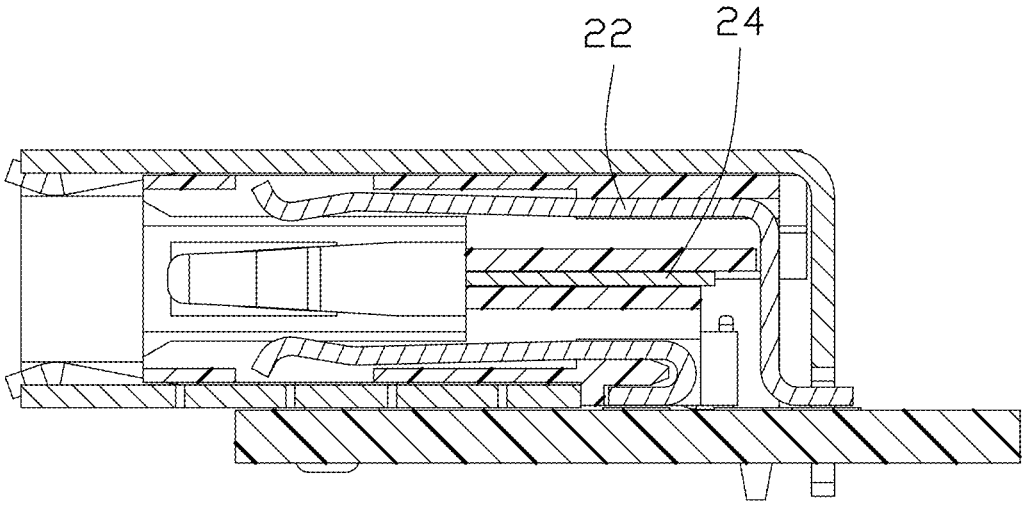
FIG. 13 is a cross-sectional view of the receptacle connector taken along lines 13-13 of FIG. 10.
Figure 14:
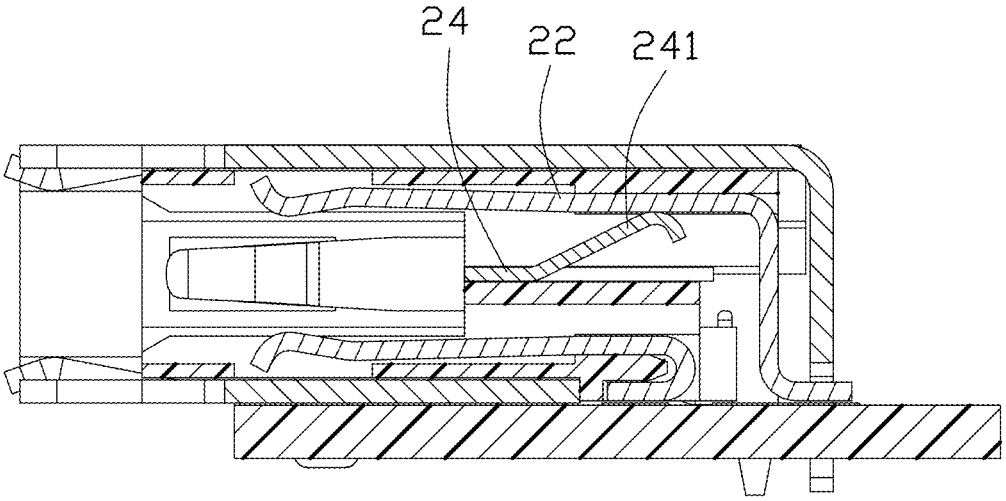
FIG. 14 is a cross-sectional view of the receptacle connector taken along lines 14-14 of FIG. 10.
Figure 15:
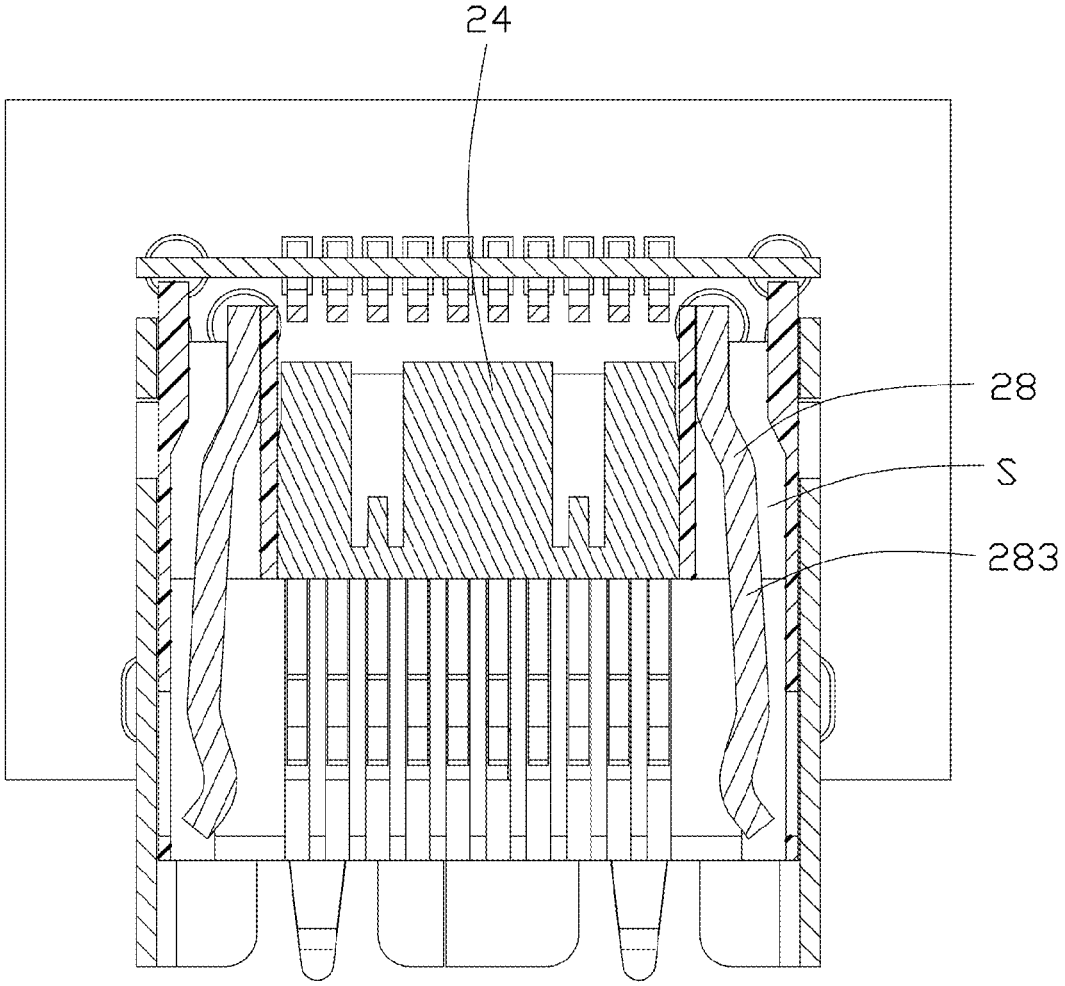
FIG. 15 is a cross-sectional view of the receptacle connector taken along lines 15-15 of FIG. 10.

Each of the housings 13 is equipped with a plurality of contacts 14 therein via an insert molding process. A pair of Vbus or power contacts 18 are located by two opposite lateral sides of the paddle card 11 and each sandwiched between the paddle card 11 and the housing 13. The power contacts 18 are stamped and formed from a carrier strip. The pair of housings 13 with the internal paddle card 11 and the associated power contacts 18 and contacts 14 are formed as a sub-assembly 101 as shown in FIG. 7. Opposite first shell 15 and second shell 16 are assembled together to commonly sandwich the aforementioned sub-assembly 101 therein. Each shell 15, 16 includes an EMI touch pad 151, 161 located behind contacting sections 141 of the contacts 14 as shown in FIG. 8. The front portions of the housings 13 form a mating tongue 102 with the contacting sections 141 and the touch pads 151, 161 exposed to an exterior thereon. An overmolded cover 17 is applied upon exterior surfaces of the shells 15 and 16, and the cable 90 is mechanically and electrically connected to the paddle card 11 and extends rearward out of the overmolded cover 17.

Figure 4:
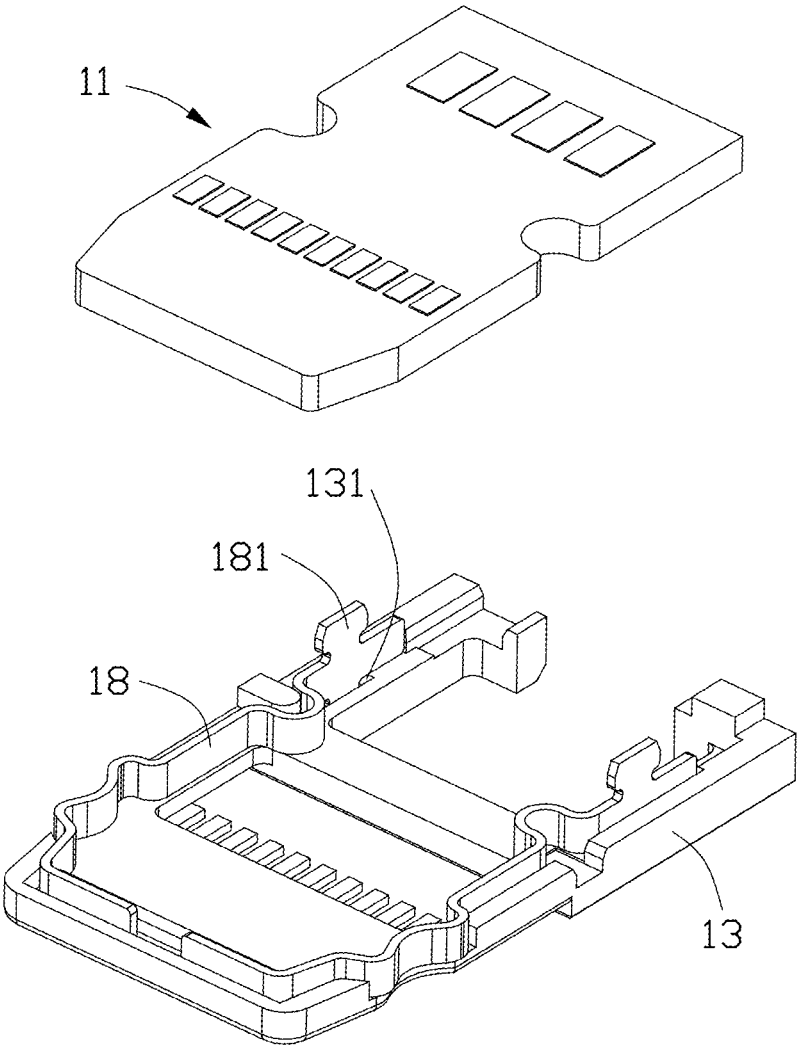
FIG. 4 to FIG. 8 show successive perspective views of the plug connector of FIG. 2 to illustrate the assembling procedure.
Figure 5:
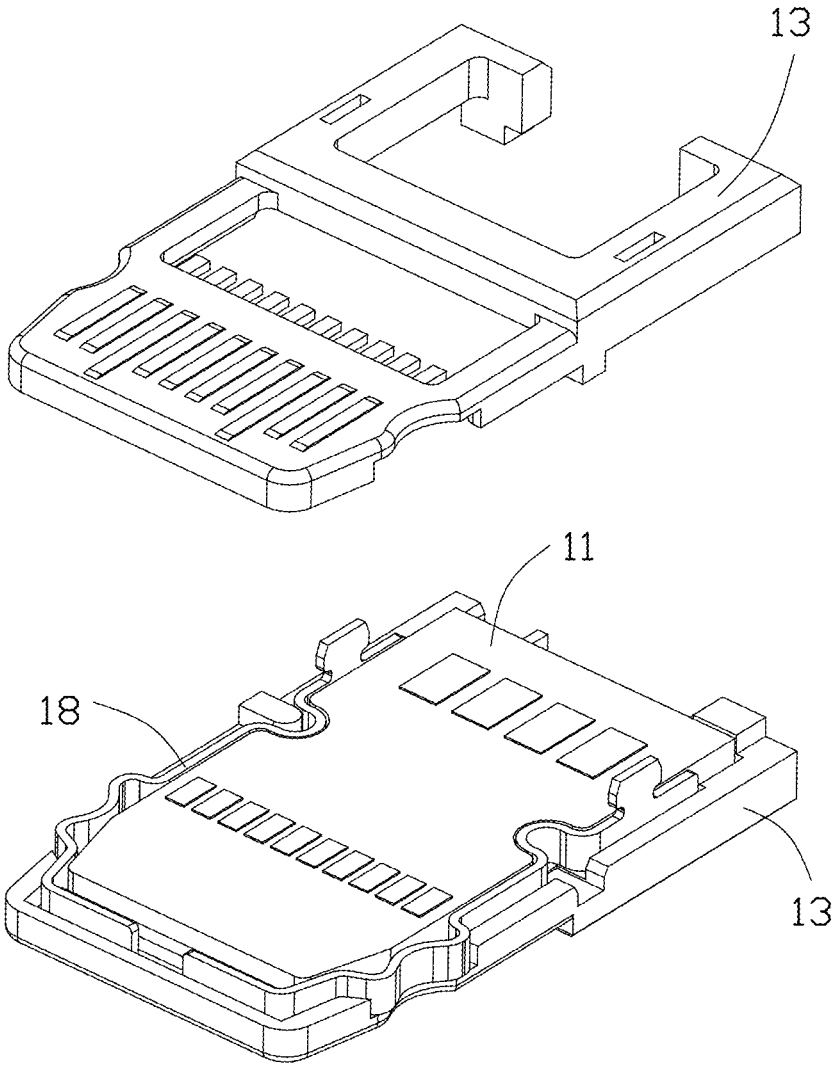
Figure 6:
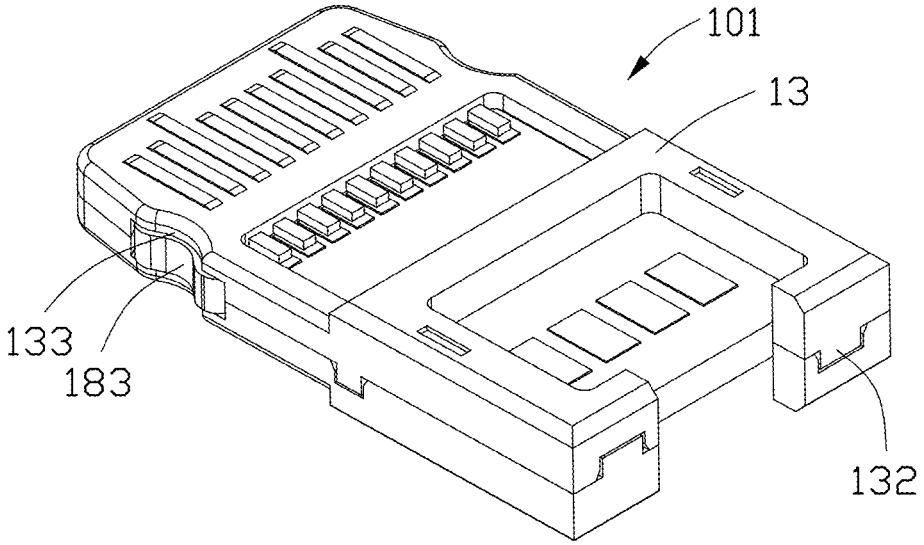

The assembling steps include: (Step 1 as shown in FIG. 4) inserting the power contacts 18 into one/lower the housing 13 via the engaging tab 181 of the power contact 18 received in the hole 131 in the housing 16; (Step 2 as shown in FIG. 5) inserting the paddle card 11 into the housing 13, the paddle card is surrounding by the power contacts 19; (Step 3 as shown in FIGS. 5 and 6) assembling the other/upper housing 13 to the lower housing 13 with key structures 132 coupled with each other to form a sub-assembly 101; (Step 4 as shown in FIG. 7) assembling the sub-assembly 101 to the second shell 16; (Step 5 as shown in FIG. 8) assembling the first shell 15 to the second shell 16; (Step 6 as shown in FIG. 8) securing the first shell 15 and the second shell 16 together via protruding tabs 161 on the second shell 16 received in the corresponding holes 151 in the shell 15; (Step 7) bending the tab 162 of the second shell 16 against the shell 15; (Step 8) assembling the cable 90 to the paddle card 11 and secured by the shells 15, 16 and overmolded within the overmolded cover 17. Notably, the contacting sections 141 and the touch pad 151, 161 are both exposed to an exterior in front of the overmolded cover 17. After step 3 and before step 4, all the contacts 14 and the power contacts 18 are soldered to the paddle card 11 via an IR reflow wherein the contacts 14 are soldered to the circuit pads 111, and the notch structure 182 of the power contacts 18 are soldered to the notch structures 113 of the paddle card 11. The power contact 18 includes a recessed region 183 exposed to an exterior through an opening 133 formed in a boundary of the assembled housings 13 wherein the recessed region 183 is substantially a so-called complete pass-thru rather than a blind pocket and is deflectable for coupling to the corresponding power contact of the complementary receptacle connector as shown in FIG. 7.

Referring to FIGS. 10-15, the plug connector 100 is mateable with the complementary receptacle connector 200 mounted upon the mother board 91. The receptacle connector 200 includes an insulative housing 21 defining a receiving cavity 201 to receive the mating tongue 101 of the housings 13. Two rows of contacts 22 deflectable in the vertical direction, are disposed in the corresponding passageways 211 of the housing 21 and by opposite two upper and lower sides of the receiving cavity 201 for mating with the contacts 14 of the plug connector 100. Each of the contacts 22 includes a front mating section 221 for mating with the contacts 14 of the plug connector 100, a tail section 222 for mounting to the mother board 91, and a retention section 223 therebewteen for retaining the contact 22 in the housing 21. A pair of power contacts 28 deflectable in the lateral direction, are located in the housing 21 and by opposite two lateral sides of the receiving cavity 201 for mating with the power contacts 18 of the plug connector 100. Each of the power contacts 28 includes a front contacting section 281 for receivable engagement within the recessed region 183 of the power contact 18 (labeled in FIG. 6) of the plug connector 100, and a rear tail section 282 for mounting to the mother board 91, and therebetween an intermediate section 283 laterally offset from the front contacting section 281 and the rear tail section 282. The housing 21 forms a plurality of recesses 213, 214 corresponding the contacts 22 and the power contacts 28 for allowing outward deflection of such contacts 22 and power contacts 28, respectively. The housing 21 further defines a space S outwardly beside the intermediate section 283 so as to forgive outward deflection of the intermediate section 283.

The receptacle connector 200 further includes a metallic shell 23 enclosing the housing 21 with a plurality of legs 231 extend downwardly beyond a bottom face of the shell for mounting to the mother board 91, and a plurality of spring tangs 232 extending around a front edge of the shell for electrically and mechanically contacting the touch pads 151, 161 of the plug connector 100. Optionally, a metallic shielding plate 24 is received in a receiving slot 216 in the housing 21 between two rows of contacts 24. The selected passageways 217 receiving the grounding contacts, extend to reach receiving slot 216 so as to allow the spring tag 241 of the shielding plate 24 to extend therethrough for contacting the grounding contacts. It is noted that the shielding plate 24 is inserted into the receiving slot 216 rearwardly via the receiving cavity 201. In some arrangement, the connector have one lane SS+ only and chooses the same row SS+ as inter-connection path.

Figure 16:
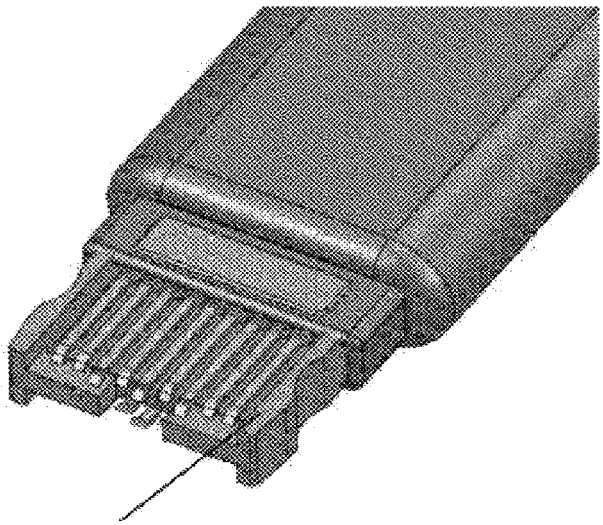
FIG. 16 is a perspective view of the plug connector of another embodiment.
Figure 17:
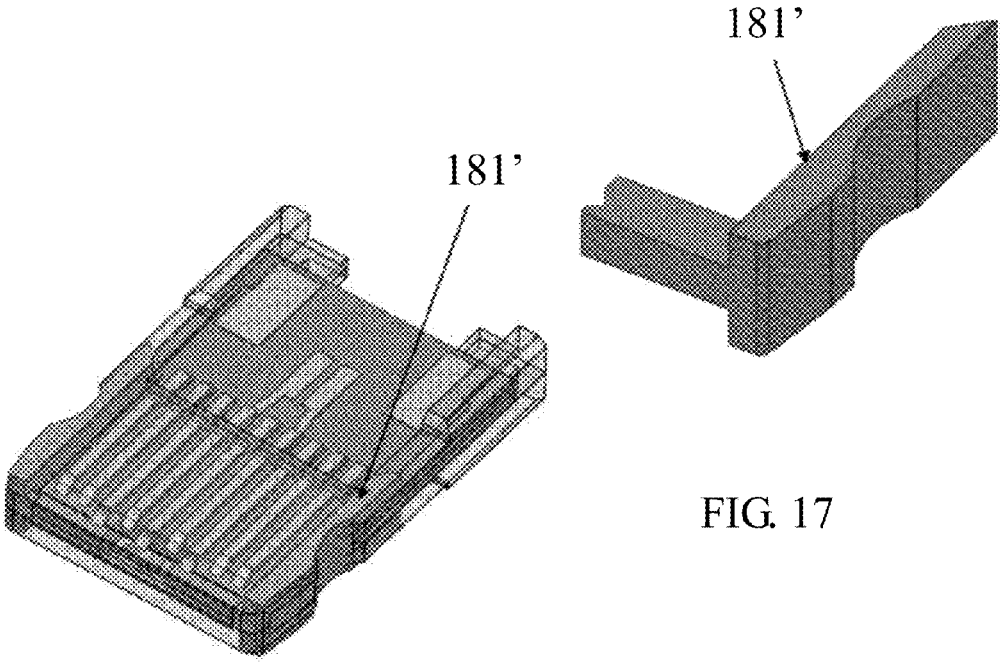
FIG. 17 is a partially exploded perspective view of the plug connector of FIG. 16.
Figure 18:
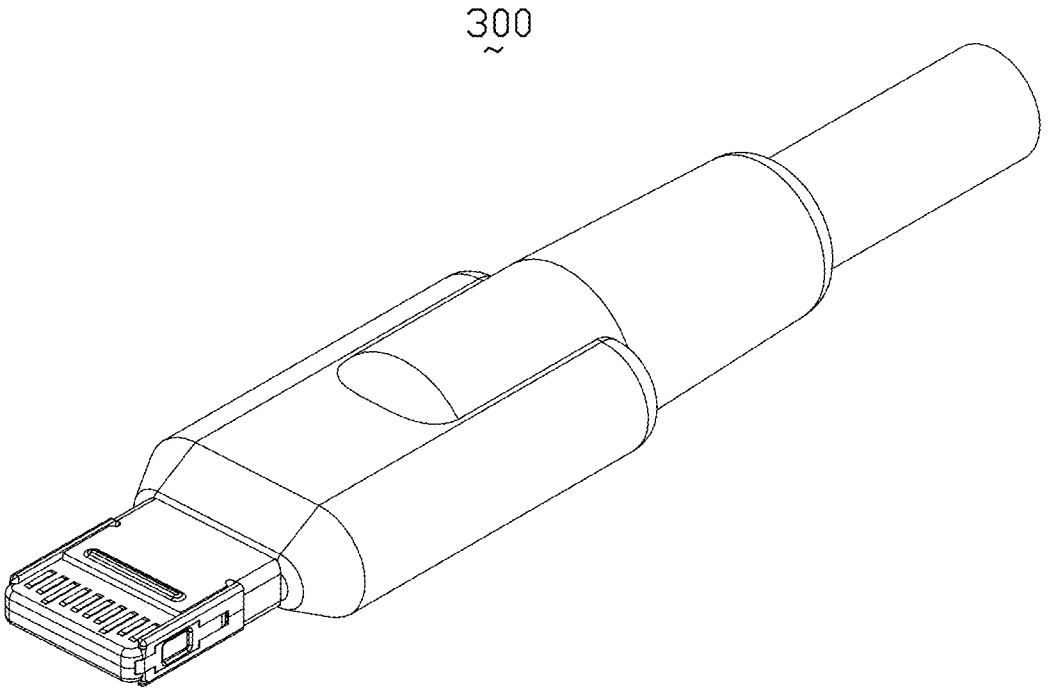
FIG. 18 is an assembled perspective view of the plug connector according to a second embodiment of the present invention.
Figure 19:
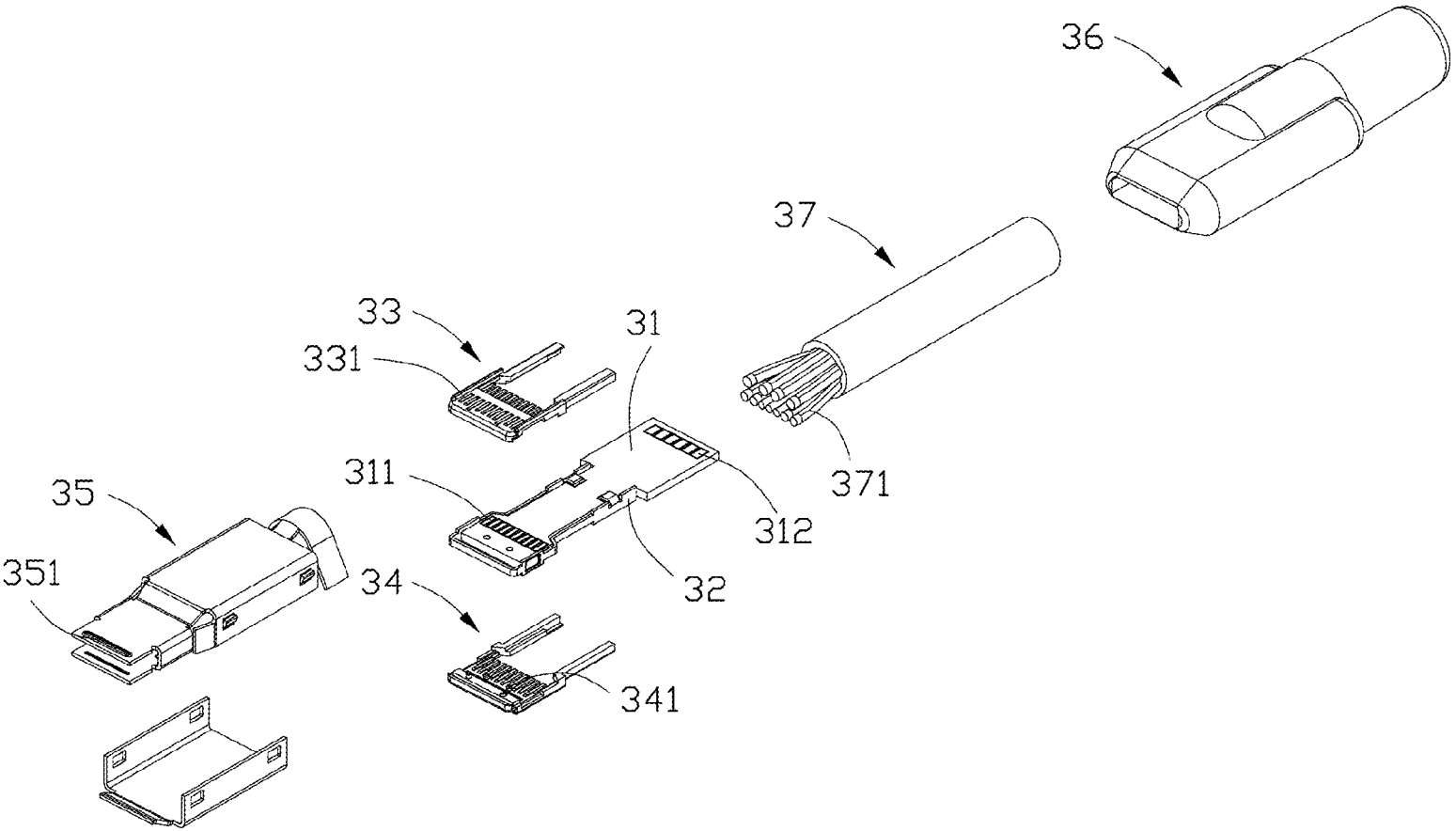
FIG. 19 is an exploded perspective view of the plug connector of FIG. 18.
Figure 20A:
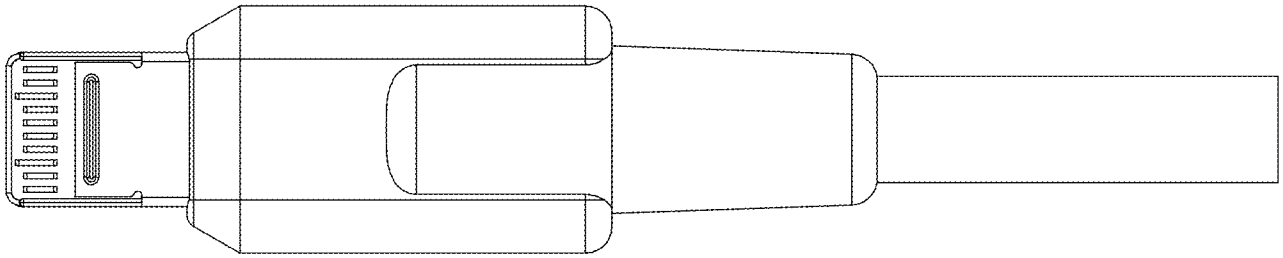
FIG. 20(A) is a top view.
Figure 20B:
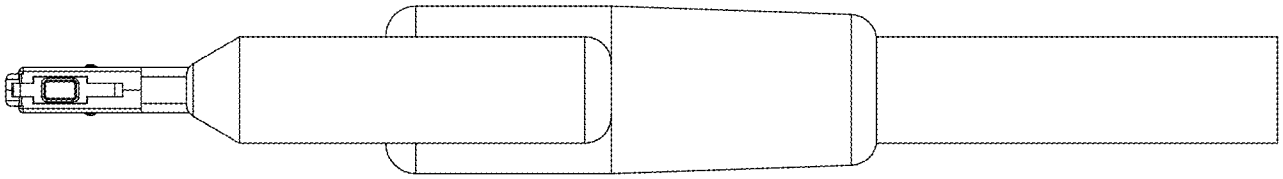
FIG. 20(B) is a side view of the plug of FIG. 18.

In another embodiment, as shown in FIGS. 16 and 17, the plug connector may have the corresponding power contacts 18' expanded to replace the side portion of the housing 13 including the anti-mismating rib structure 181'. Understandably, in this embodiment the power contacts 18' is not deflectable but stiff.

Figure 21:
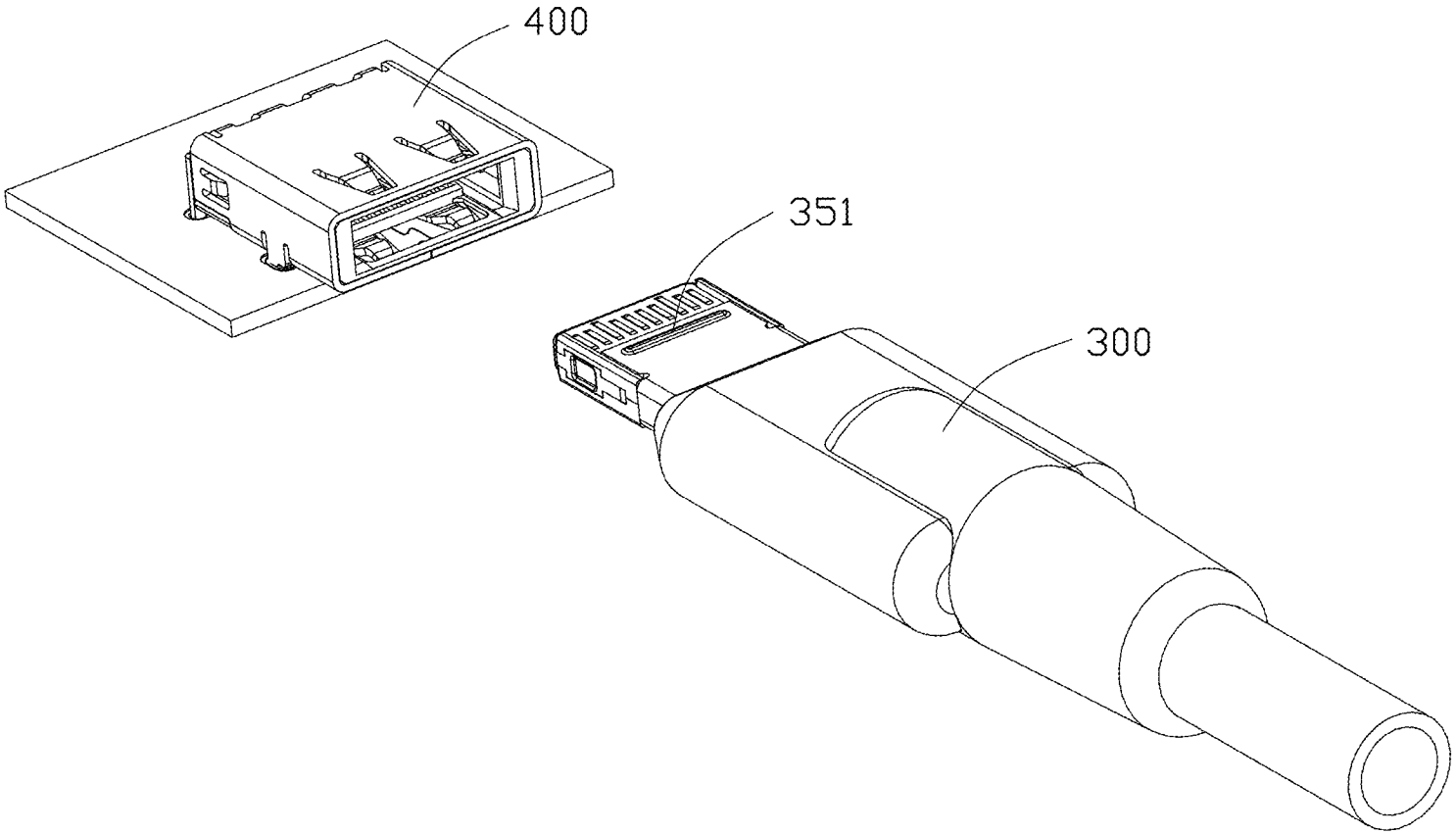
FIG. 21 is an assembled perspective view of the plug connector of FIG. 18 ready for mating with a corresponding receptacle connector mounted upon a printed circuit board.
Figure 22:
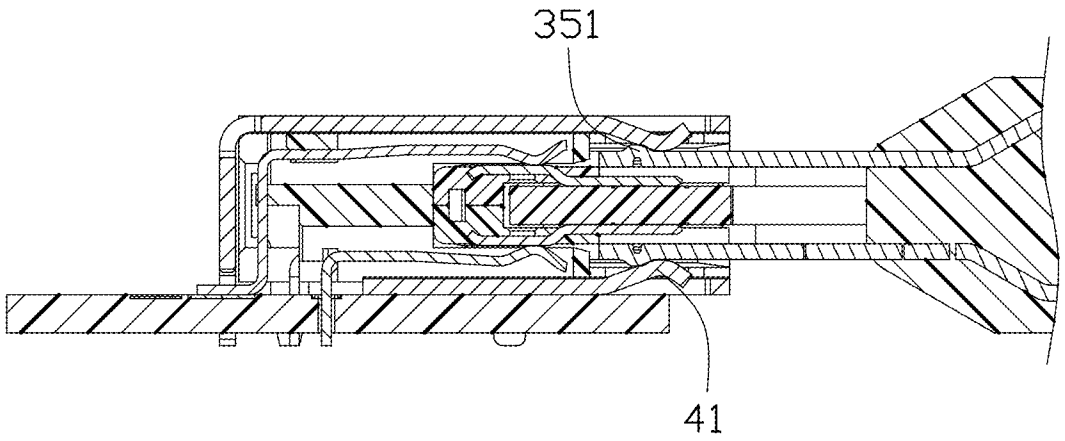
FIG. 22 is a side cross-sectional view of the mated plug connector and receptacle connector of FIG. 21.

FIGS. 18-22 essentially disclose a plug connector 300 of a second embodiment of this invention. Referring to FIGS. 18-21, the plug connector 300 includes a paddle card 31 with front circuit pads 311 and rear circuit pads 312 thereon and a U-shaped power clip 32 surrounding a front edge and two side edges. An upper insulative housing 33 is located upon an upper face of the paddle card 31 with associated upper contacts 331, and a lower insulative housing 34 is located under the paddle card 31 with associated lower contacts 341, wherein the upper contacts 331 and the lower contacts 341 define corresponding front contacting sections exposed to an exterior and rear mounting sections mounted to the corresponding front circuit pads 31, respectively. Upper and lower metallic shells 35 are assembled together to enclose the paddle card 31 and the upper housing 33 and the lower housing 34 therein. An insulative cover 36 is overmolded upon the shells 35 and a cable 37 which encloses a plurality of wires 371 having front ends mechanically and electrically connected to the rear circuit pads 312. Each shell 35 includes a bumps 351 for enhancement during mating with a deflectable tang 41 of the receptacle connector 400 as shown in FIGS. 21 and 22.

Figure 23:
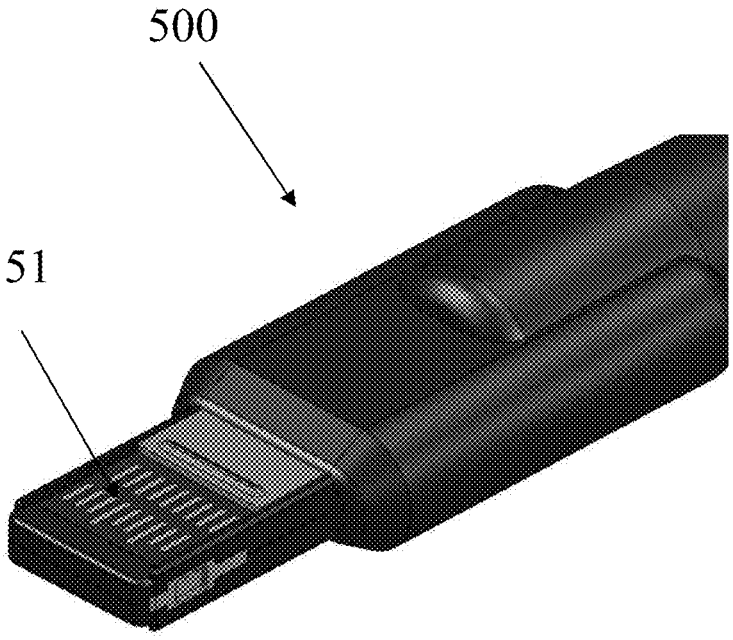
FIG. 23 is an assembled perspective view of the plug connector of another embodiment of the instant invention.
Figure 24:
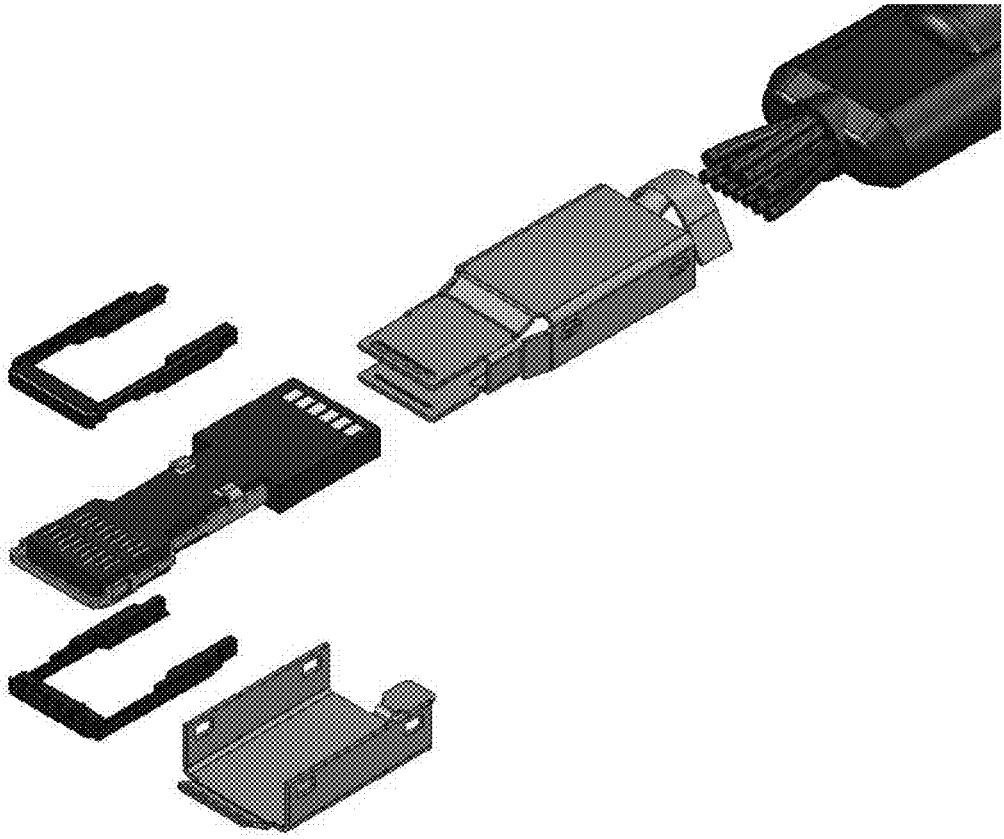
FIG. 24 is an exploded perspective view of the plug connector of FIG. 23.
Figure 25A:
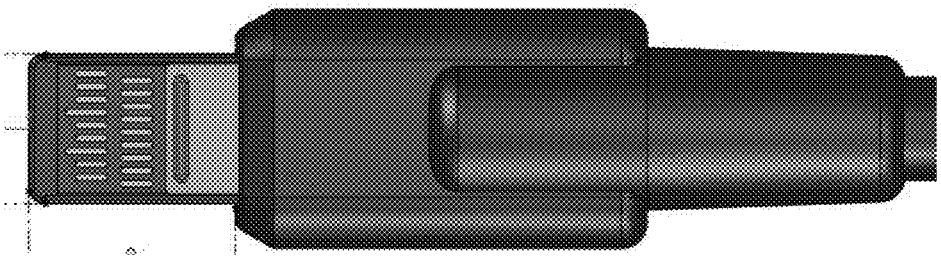
FIG. 25(A) is a top view.
Figure 25B:
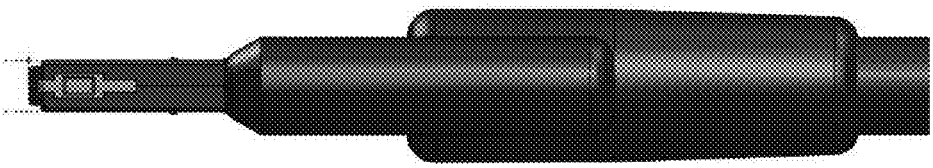
FIG. 25(B) is a side view of the plug connector of FIG. 23.
Figure 26:
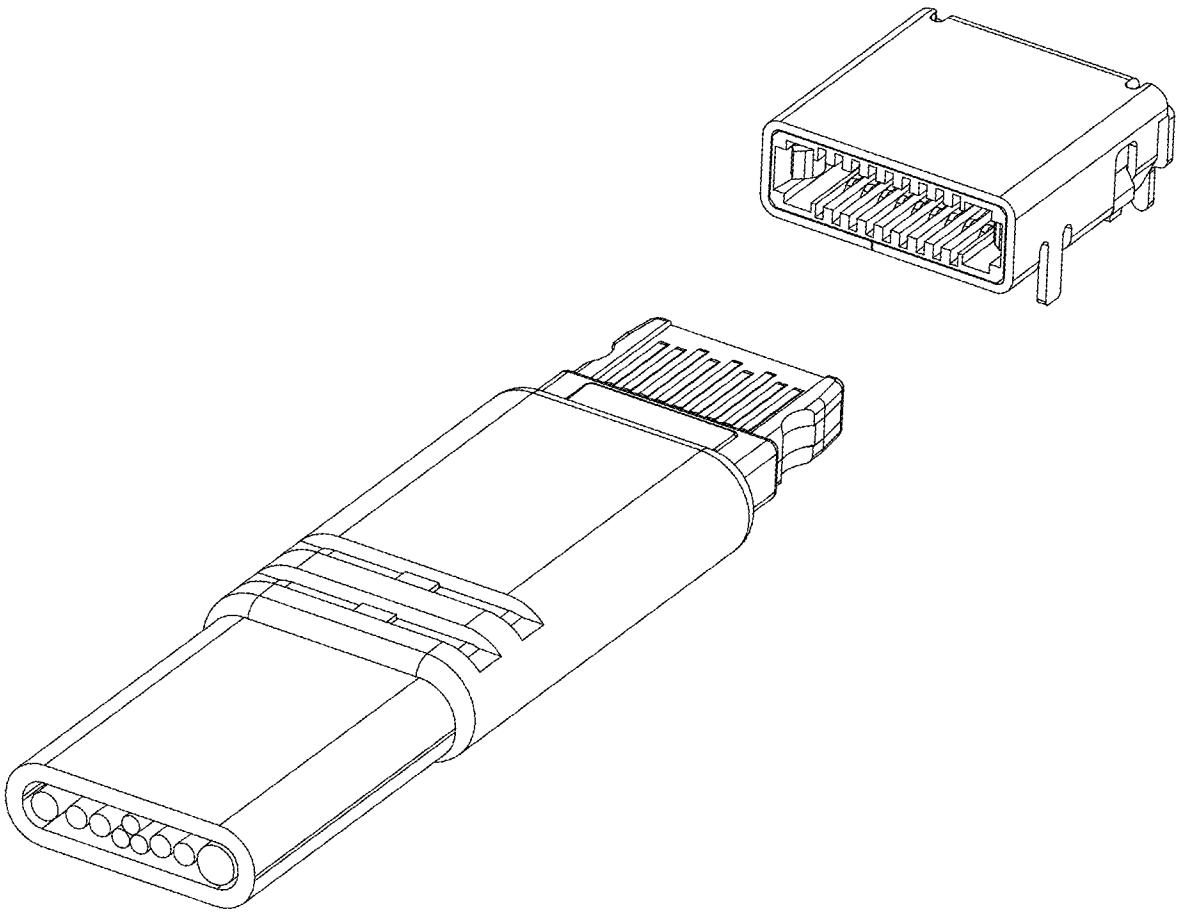
FIG. 26 is a perspective view of the plug connector and the receptacle connector of another embodiment of the invention, derived from the parent application

FIGS. 23-25 show the different type plug connector 500 having the front circuit pads 51 exposed to exterior for mating with the contacts of the receptacle connector and the upper and lower housings are no longer equipped with the corresponding upper and lower contacts in comparison with the embodiment shown in FIGS. 18-22. FIG. 26 discloses the embodiment derived from the first embodiment of the parent application.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a plug connector including:

an insulative housing unit essentially having a pair of housings each equipped with a plurality of contacts thereof, each of said contacts defining a front contacting section and a rear tail section;

a paddle card sandwiched, in a vertical direction, between the pair of housings with circuit pads mechanically and electrically connected to the corresponding rear tail sections, respectively; and a pair of metallic shells enclosing a rear portion of the housing unit but exposing a front portion of the housing unit to cooperate with a front region of the shell to be a mating tongue;

said mating tongue forms a pair of notches on two opposite lateral side edges, respectively, and a pair of conductive segments located on the two opposite lateral side edges with locking regions exposed in the notches, respectively.

2. The electrical connector assembly as claimed in claim 1, wherein an overmolded cover encloses the pair of shells with a rearwardly extending cable which is connected to the paddle card.

3. The electrical connector assembly as claimed in claim 1, wherein the conductive segment is made from die-casting.

4. The electrical connector assembly as claimed in claim 1, wherein said pair of conductive segments deliver power.

5. The electrical connector assembly as claimed in claim 1, wherein the pair of conductive segments are sandwiched between the pair of housings in said vertical direction.

6. The electrical connector assembly as claimed in claim 1, wherein the conductive segment is made of sheet metal defining a thickness thereof, and the thickness of the locking region extends transversely.

7. The electrical connector assembly as claimed in claim 6, wherein said pair of conductive segments are unitarily formed within a U-shaped structure which encloses front and opposite side edges of the paddle card.

8. The electrical connector assembly as claimed in claim 1, further including a receptacle connector adapted to be mated with the plug connector, wherein said receptacle connector includes an insulative body enclosed in a metallic shield to define a mating cavity, two rows of contacts disposed in the housing and located by two sides of the mating cavity in said vertical direction with corresponding contacting sections exposed in the mating cavity, a pair of conductive pieces disposed in the housing by two sides of the mating cavity in a transverse direction perpendicular to said vertical direction to mate with the conductive segments of the plug connector in a locking manner.

9. The electrical connector assembly as claimed in claim 8, wherein the insulative housing of the receptacle connector is equipped with a metallic shielding plate behind the mating cavity to separate said two rows of contacts.

10. The electrical connector assembly as claimed in claim 9, wherein said shielding plate includes at least one spring tang mechanically and electrically connecting to one grounding contact of said contacts of the receptacle connector in the vertical direction.

11. An electrical connector assembly comprising:

a first electrical connector including:

an insulative housing defining a mating cavity with two rows of contacts disposed in corresponding passageways of the housing and by two sides of the mating cavity in a vertical direction, and with a pair of conductive pieces in the housing and by two sides of the mating cavity in a lateral direction perpendicular to said vertical direction, both said contacts and said conductive pieces being outwardly deflectable with regard to the mating cavity during mating, said contacts defining signal contacts and grounding contacts;

a plurality of passageways formed in the housing to compliantly receive the outwardly deflected contacts and conductive pieces, respectively; and a metallic shell enclosing said housing;

a second electrical connector defining a mating tongue having terminals on two opposite surfaces thereof and a pair of conductive segments located on two opposite lateral edges thereof, wherein the mating tongue is received in the mating cavity, the terminals are mated with the corresponding contacts, respectively, and the conductive segments are latched and mated with the corresponding conductive pieces, respectively.

12. The electrical connector assembly as claimed in claim 11, wherein a shielding plate is disposed in the housing and between the two rows of contacts, and some passageways receiving corresponding grounding contacts extend toward and reach the shielding plate so as to allow spring tags of the shielding plate to extend therethrough to contact the corresponding grounding contacts.

13. The electrical connector assembly as claimed in claim 11, wherein the conductive piece is made of sheet metal and defines a transversely extending thickness direction in the mating cavity.

14. The electrical connector assembly as claimed in claim 11, wherein said pair of conductive segments are transversely deflectable during a mating process.

15. The electrical connector assembly as claimed in claim 11, wherein said pair of conductive segments are unitarily formed with a U-shaped structure.

16. The electrical connector assembly as claimed in claim 11, wherein said pair of conductive segments delivers power.

17. The electrical connector assembly as claimed in claim 11, wherein the mating tongue includes a paddle card sandwiched, in a vertical direction, between upper and lower terminal modules on which the terminals are located.

18. The electrical connector assembly as claimed in claim 17, wherein said pair of conductive segments are sandwiched between the upper and lower terminal modules in the vertical direction.

19. An electrical connector assembly comprising: a first electrical connector including:

an insulative housing defining a mating cavity with two rows of contacts disposed in corresponding passageways of the housing and by two sides of the mating cavity in a vertical direction, and with a pair of conductive pieces in the housing and by two sides of the mating cavity in a lateral direction perpendicular to said vertical direction, both said contacts and said conductive pieces being outwardly deflectable with regard to the mating cavity during mating, said contacts defining signal contacts and grounding contacts;

a plurality of passageways formed in the housing to compliantly receive the outwardly deflected contacts and conductive pieces, respectively; and a metallic shell enclosing said housing; wherein a shielding plate is disposed in the housing and between the two rows of contacts, and some passageways receiving corresponding grounding contacts extend toward and reach the shielding plate so as to allow spring tags of the shielding plate to extend therethrough to contact the corresponding grounding contacts;

a second electrical connector defining a mating tongue having terminals on two opposite surfaces thereof and a pair of conductive segments located on two opposite lateral edges thereof, wherein the mating tongue is received in the mating cavity, the terminals are mated with the corresponding contacts, respectively, and the conductive segments are latched and mated with the corresponding conductive pieces, respectively.

20. The electrical connector assembly as claimed in claim 19, wherein the conductive piece is made of sheet metal and defines a transversely extending thickness direction in the mating cavity.

* * * * *